US005644858A

United States Patent [19]

Bemis

[11] Patent Number: 5,644,858

[45] Date of Patent: Jul. 8, 1997

[54] INERTIALLY RESPONSIVE FOOTWEAR LIGHTS

[75] Inventor: Jon L. Bemis, Santa Monica, Calif.

[73] Assignee: L.A. Gear, Inc., Santa Monica, Calif.

[21] Appl. No.: 162,423

[22] Filed: Dec. 2, 1993

[51] Int. Cl.[6] ..... A43B 23/00

[52] U.S. Cl. ..... 36/137; 36/136; 362/103

[58] Field of Search ..... 36/137, 136, 139; 362/103, 276, 802

[56] References Cited

U.S. PATENT DOCUMENTS

| | | | |
|---|---|---|---|
| 1,597,823 | 8/1926 | Randolph | 36/137 X |
| 1,933,243 | 10/1933 | Demerolis et al. . | |
| 2,572,760 | 10/1951 | Rikelman . | |
| 2,671,847 | 3/1954 | Lerch | 36/137 X |
| 2,931,893 | 4/1960 | Arias et al. . | |
| 2,976,622 | 3/1961 | Shearouse | 36/137 X |
| 3,008,038 | 11/1961 | Dickens et al. . | |
| 3,070,907 | 1/1963 | Rocco . | |
| 3,893,247 | 7/1975 | Dana, III . | |
| 4,014,115 | 3/1977 | Reichert . | |
| 4,128,861 | 12/1978 | Pelengaris . | |
| 4,130,951 | 12/1978 | Powell . | |
| 4,158,922 | 6/1979 | Dana, III . | |
| 4,253,253 | 3/1981 | McCormick . | |
| 4,848,009 | 7/1989 | Rodgers . | |
| 4,897,947 | 2/1990 | Kass-Pious | 36/136 X |
| 5,052,131 | 10/1991 | Rondini . | |
| 5,188,447 | 2/1993 | Chiang . | |
| 5,235,761 | 8/1993 | Chang | 36/137 X |
| 5,285,586 | 2/1994 | Goldston et al. | 36/137 |
| 5,303,131 | 4/1994 | Wu | 36/137 X |
| 5,303,485 | 4/1994 | Goldston et al. | 36/137 |
| 5,343,190 | 8/1994 | Rodgers | 36/137 X |
| 5,419,061 | 5/1995 | Barrocas | 36/137 |

FOREIGN PATENT DOCUMENTS

| | | | |
|---|---|---|---|
| 2556190 | 6/1985 | France | 36/137 |
| 2675025 | 10/1992 | France | 36/137 |
| 3824352 | 2/1990 | Germany | 36/136 |

*Primary Examiner*—Ted Kavanaugh
*Attorney, Agent, or Firm*—Don C. Lawrence, Esq.

[57] ABSTRACT

An inertially responsive lighting system (10) for footwear has at least one electric light source (12), a battery (16), circuit means (22) to connect the battery to the light, and electro-mechanical switching means (24) disposed in the circuit means that are responsive to an inertial impulse force acting on the footwear to cause the light to flash on and off for a brief interval after the force is applied.

20 Claims, 3 Drawing Sheets

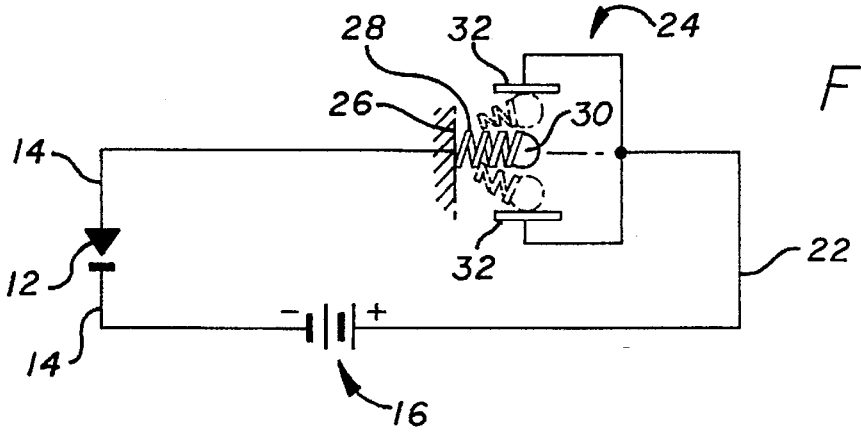
FIG. 6
FIG. 7
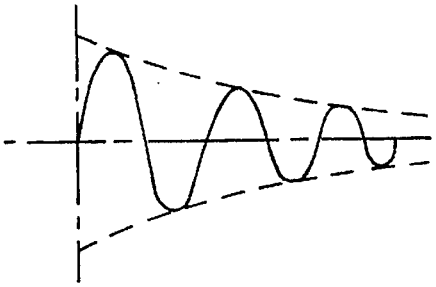
FIG. 9
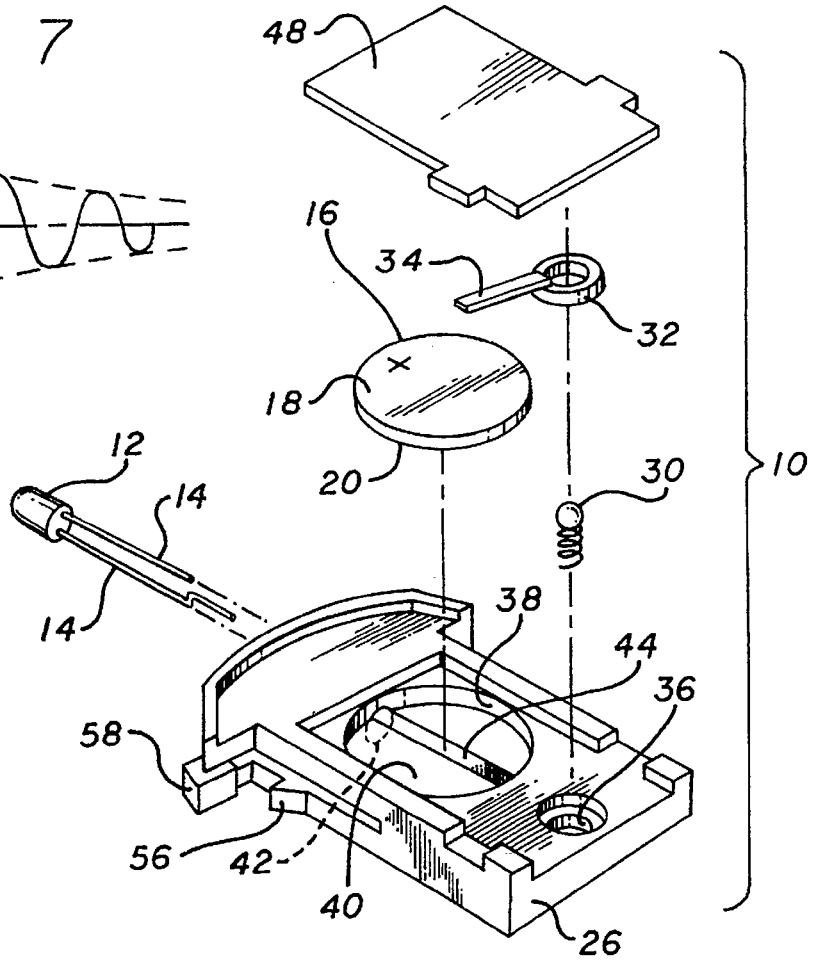
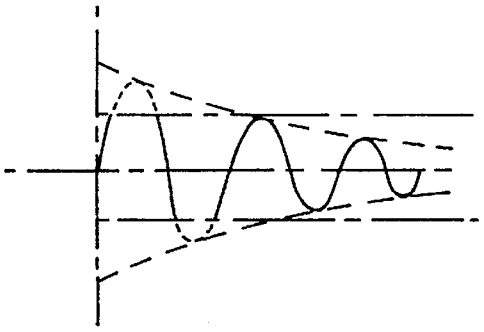
FIG. 8

INERTIALLY RESPONSIVE FOOTWEAR LIGHTS

BACKGROUND OF THE INVENTION

RELATED APPLICATIONS

This application is related to this applicant's allowed applications, Ser. No. 07/917,000 now U.S. Pat. No. 5,285,586, filed Jun. 26, 1992, and Ser. No. 08/013,839, filed Feb. 5, 1993, now U.S. Pat. No. 5,303,485, the disclosures of which, by this reference, are incorporated herein in their entireties.

1. Field of the Invention

This invention pertains to lighted footwear in general, and in particular, to footwear having lights that flash on and off periodically in response to inertial forces acting on the footwear, such as those incident on the footwear when it impacts against the ground.

2. Description of the Related Art

The provision of lights in shoes and boots to achieve a variety of utilitarian or novelty effects is well known in the footwear art. Typical offerings comprise one or more small sources of electrical light, e.g., incandescent bulbs, neon tubes, or light-emitting diodes ("LED's"), a small portable power source, such as a dry-cell battery, and some electrical circuitry to connect the power source to the light sources electrically, which circuitry usually includes some means for switching the light sources on and off in a desirable fashion.

In some cases, this switching function is achieved by the provision of a simple, manually-actuated on/off switch on the footwear, such as are to be found in the lighted sandal described by B. Arias, et al., in U.S. Pat. No. 2,931,893, and the lighted, detachable heel described in U.S. Pat. No. 4,253,253 to A. McCormick. While these systems are simple and inexpensive to implement, they do not provide a very dynamic light display or one that is interactive with the wearer's activities, such as would be achieved by a lighting system that is operatively responsive to, say, movement of the footwear, or its impact upon, or departure from, the ground. Also, since the lights are continuously "on" until switched "off" manually, rapid battery exhaustion can be a problem.

Numerous examples of efforts made to overcome one or both of these problems may be found in the patent literature. For example, each of the following patents describes a variant of lighted footwear in which a displacement-actuated switch is disposed above, within, or below the sole of the footwear, frequently in the heel, to switch the lights on when the footwear is in contact with the ground, and to switch them off when it is not: U.S. Pats. No. 1,933,243 to J. De Merolis, et al.; U.S. Pat. No. 3,008,038 to M. Dickens, et al.; U.S. Pat. No. 3,070,907 to J. Rocco; U.S. Pat. No. 3,800,133 to H. Duval; U.S. Pat. No. 4,014,115 to R. Reichert; U.S. Pat. No. 4,128,861 to A. Pelengaris; and U.S. Pat. No. 4,130,951 to A. Powell. While these systems all generally provide a more dynamic mode of light actuation, they also all share a common problem, namely, relatively quick battery depletion, since the lights in the footwear are continuously "on" while the footwear is in contact with the ground, such as occurs in activities involving much standing.

In U.S. Pat. No. 2,572,760, N. Rikelman describes a lighting device for footwear that clips over the instep of a shoe or boot. In one of the embodiments illustrated, the switching function of the incandescent light is achieved by a ball bearing disposed inside of a tube to roll randomly, with movement of the footwear, into and out of engagement with an electrical contact to switch the light on and off.

In U.S. Pat. No. 5,052,131, P. Rondini describes a sandal having an oscillator circuit that is actuated by means of a displacement switch in the heel of the sandal to cause the light sources in the sandal's straps to flash on and off periodically. This flashing actuation of the lights not only provides a more dynamic light display, but can also prolong battery life, depending on the "duty cycle" of the oscillator circuit.

In this applicant's above-referenced copending application, Ser. No. 08/013,839, filed Feb. 5, 1993, variants of footwear lighting systems are described in which the lights are switched on whenever the wearer's foot leaves the ground, and are switched off when the wearer's foot is in contact with the ground. While these systems are also relatively more dynamic in appearance and can provide prolonged battery life, some additional switching means are necessary to switch the lights off when the wearer's foot is off the ground for an extended time, such as when the wearer sits with a leg crossed.

In U.S. Pats. Nos. 3,893,247 and 4,158,922, A. Dana III describes lighted footwear in which the lights are connected to, or disconnected from, the battery by means of a mercury switch mounted in the footwear, which makes or breaks the battery-light connection in response to the position of the switch relative to the gravity gradient. In the latter reference, an optional oscillator circuit is described which causes the lights to flash on and off periodically when the mercury switch is in the "on" position, and an optional battery charging circuit can be included to re-charge a depleted battery. It may be seen that, while both of these systems can provide a more dynamic lighting effect and extended battery life, the actuation, and "on" period itself, of the lights can be unpredictable and is highly dependant on the mounting attitude of the mercury switch in the footwear.

In U.S. Pat. No. 4,848,009, N. Rodgers describes lighted footwear in which a mercury switch is used in a manner similar to the two references described above to trigger an integrated "timing" circuit, which in turn, turns the lights in the footwear on for a predetermined period of time, then turns them off again, and keeps them turned off until the mercury switch is first opened, then closed again. Although relatively more complex, from an electronics standpoint, this system provides a satisfactory dynamic lighting effect, along with an extended battery life, due primarily to the fact that the predetermined period of time during which the lights are "on" can be set to be relatively brief, such that the "on" period corresponds to a brief "flash" of the lights.

In U.S. Pat. No. 5,188,447, L. Chiang, et al., describe a lighted footwear system in which the lights are actuated by the impact of the footwear against an object, such as the ground. In this system, a piezoelectric crystal operates as a voltage generator to generate a brief voltage pulse, the amplitude of which is related to the amount of inertial force incident upon the crystal. The voltage pulse is used as the input of a battery-driven amplifier, which, in turn, drives the lights, such that the intensity of the single pulse of light emitted by the lights is related to the mount of force with which the footwear impacts the object. Like the Rodgers system described above, this lighting system provides a dynamic, interactive lighting response, and is relatively conservative of battery life, but is also relatively more complex and expensive to implement in low-cost footwear.

The present invention relates to lighted footwear in which the lights are actuated by an improved switching mechanism that is responsive to inertial forces acting on the footwear, such as those incident on the footwear when impacting the ground or kicking a ball, to cause the lights to flash on and off periodically for only a very brief period, thereby providing a relatively dynamic, interactive lighting effect, while achieving a relatively long battery life. This novel system is achieved in a design that is very simple and reliable in its operation, inexpensive to manufacture, small and lightweight, and therefore, ideal for incorporation into footwear.

SUMMARY OF THE INVENTION

The inertially responsive lighting system for footwear of the present invention comprises at least one source of electric light, a battery for energizing the light source, an electrical circuit for connecting the battery to the light source, and an improved switching means disposed within the connecting circuit for connecting and disconnecting the battery to and from the light source in response to inertial forces acting on the footwear.

The improved switching means comprise a mounting base disposed within the footwear, and an electrically conductive spring-mass system resiliently mounted on the base and electrically connected to the circuit. The spring-mass system has at least one degree of freedom of harmonic, or oscillatory, motion relative to an equilibrium position on the base in response to the incidence of a force acting on the base. An electrically conductive surface is also connected to the circuit, and is mounted on the base in opposed relation to the spring-mass system such that, when any part of the spring-mass system is in contact with the surface, the battery is connected to the light source, thereby switching the light source on, and when the spring-mass system and the surface are separated, the battery is disconnected from the light source, thereby switching the light source off.

The spring rate of the spring-mass system and its spacing from the conductive surface can be pre-set such that the application of an inertial force to the footwear, such as occurs when the footwear impacts the ground, sets up a rapidly-decaying oscillatory motion in the spring-mass system wherein it alternately contacts and separates from the adjacent conductive surface, thereby causing the light source to flash on and off periodically for a very brief period of time.

In a preferred embodiment, the mounting base can further comprise a housing in which the light sources, the battery, the connecting circuit, and the improved switching means are all integrally contained for insertion into or removal from the footwear as a single assembly, in a plug-in, releasibly-retained fashion.

A better understanding of the details and operation of the novel footwear, along with its many attendant advantages, may be had from a consideration of the following detailed description of its preferred embodiments, particularly if these are considered in light of the accompanying drawings. A brief description of these drawings now follows.

BRIEF DESCRIPTION OF THE DRAWINGS

FIG. 6 is a schematic diagram of the lighting system of the present invention;

FIG. 7 is a graph showing the decaying harmonic displacement with time of an unconstrained spring-mass system contained in the lighting system with respect to an equilibrium position of the spring-mass system;

FIG. 8 is a graph similar to that seen in FIG. 7, except the displacement of the spring-mass system is constrained; and, FIG. 9 is an exploded isometric view of the inertially responsive footwear lighting system shown in FIG. 1.

DETAILED DESCRIPTION OF THE PREFERRED EMBODIMENTS

Figure 1:
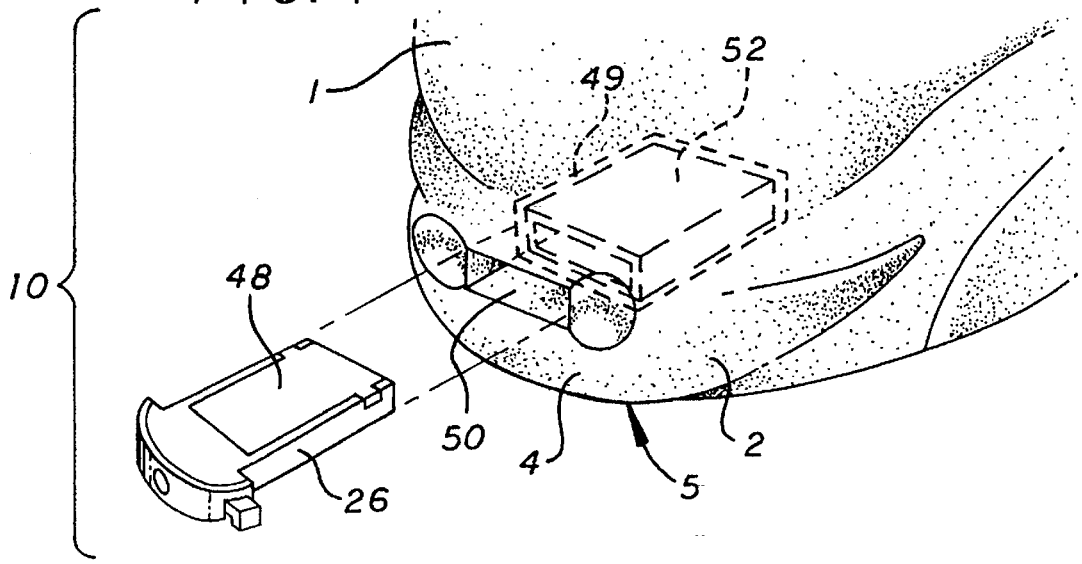
FIG. 1 is a partial isometric view of a rear, heel area of lighted footwear, namely, a shoe, incorporating the new, inertially responsive lighting system of the present invention, showing the lighting system extracted from a retaining receptacle in a sole portion of the shoe through an opening in a sidewall of the sole.
Figure 2:
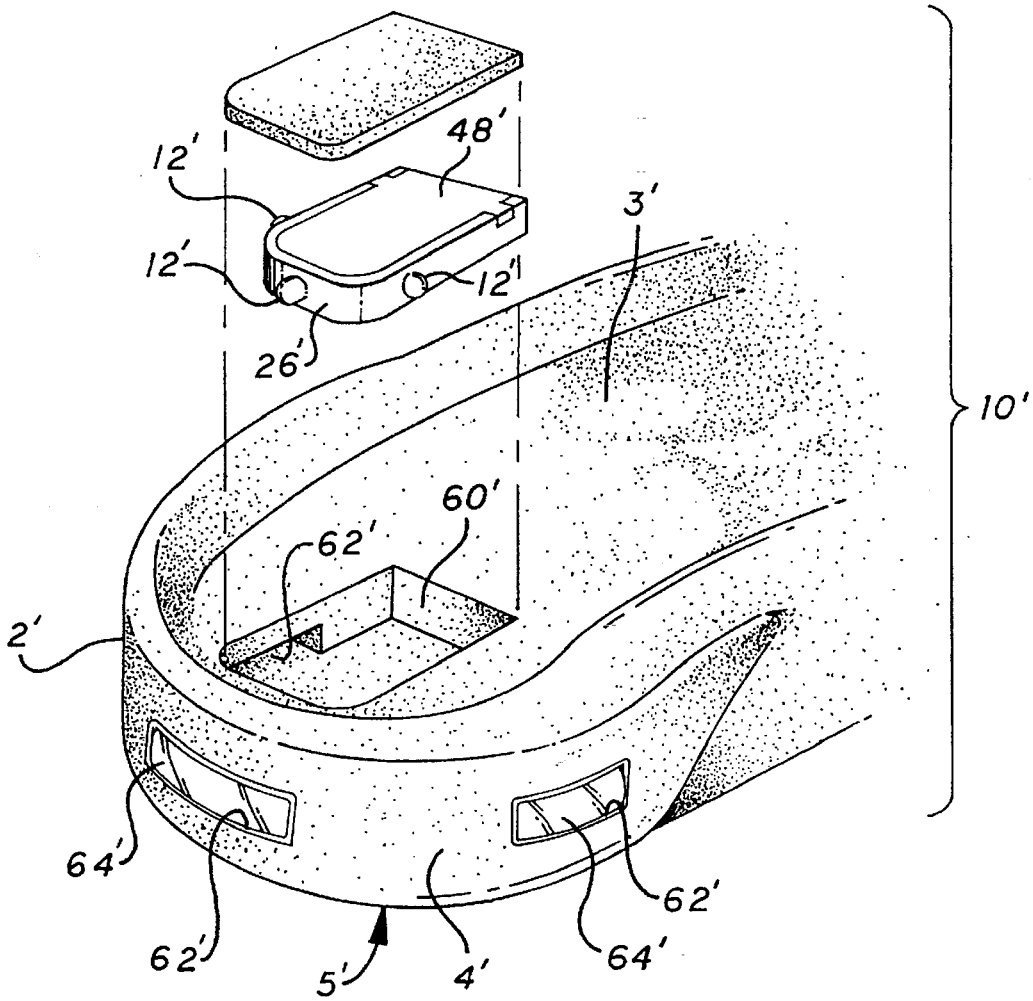
FIG. 2 is a partial isometric view of the rear, heel area of a lighted shoe similar to that seen FIG. 1, wherein an alternative embodiment of the inertially responsive lighting system of the present invention is shown expanded out of a retaining cavity contained in the sole of the shoe through an opening in a top surface of the sole.

As seen in FIGS. 1 and 2, modem footwear, particularly the type of athletic and casual shoes to which the present invention is readily adapted, typically comprise a soft, flexible upper portion 1 adapted to surround at least a portion of the upper surface of a wearer's foot, and a resilient sole portion 2 attached to the bottom of the upper portion 1 and adapted to underlie the wearer's foot and protect it against uncomfortable contact with the ground.

Typical upper materials include leather and man-made sheet materials, such as polyvinyl or polyurethane sheets, or combinations of these, which are die- or laser-cut and then stitched together over a foot-shaped last to form the finished upper 1. The sole portion 2 is typically molded of man-made elastomeric materials, such as foamed or solid polyurethane or ethylene vinyl acetate, to include certain common structural features, such as a top, or "footbed," surface 3, a peripheral sidewall surface 4, and a bottom, or ground-contacting surface 5, and may further comprise a series of layered components, such as an outsole component, a midsole component, and an insole component (not illustrated). The sole portion is attached on its upper surface 3 to a lower margin of the upper portion, typically by adhesive means.

Figure 3:
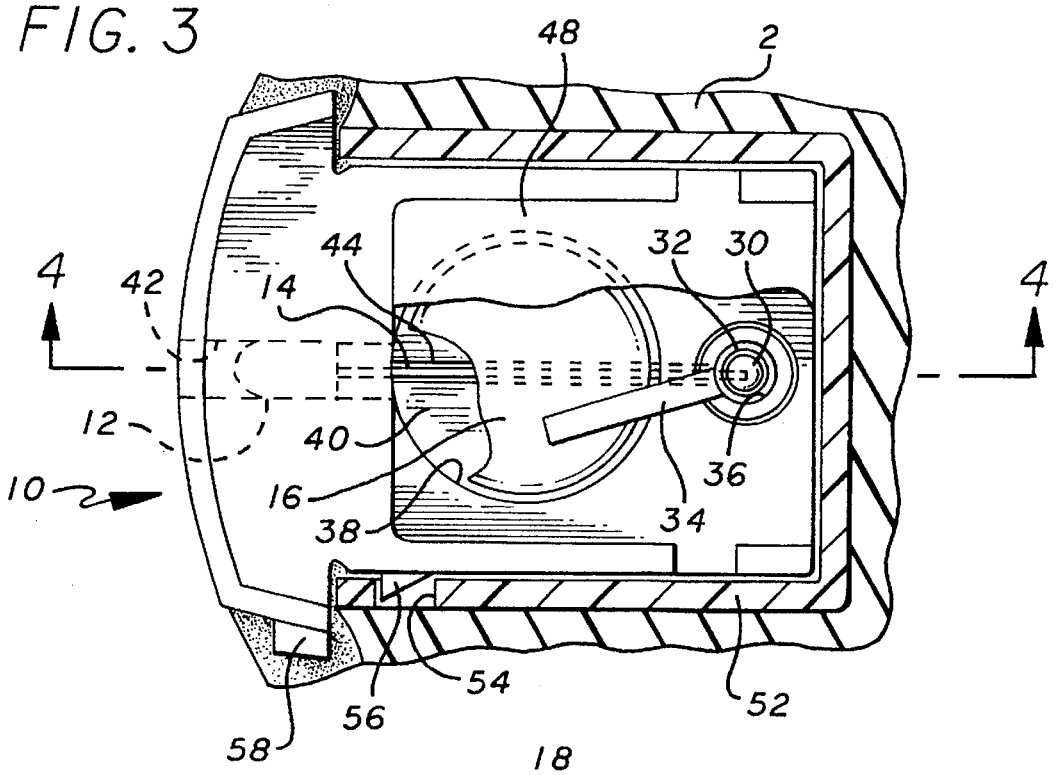
FIG. 3 is a partial sectional view taken through the sole and retaining receptacle of the shoe of FIG. 1 to reveal a top plan view of the lighting system, showing a cover and a battery of the system partially broken away; and wherein a sectional view is taken along the lines 4—4.
Figure 4:
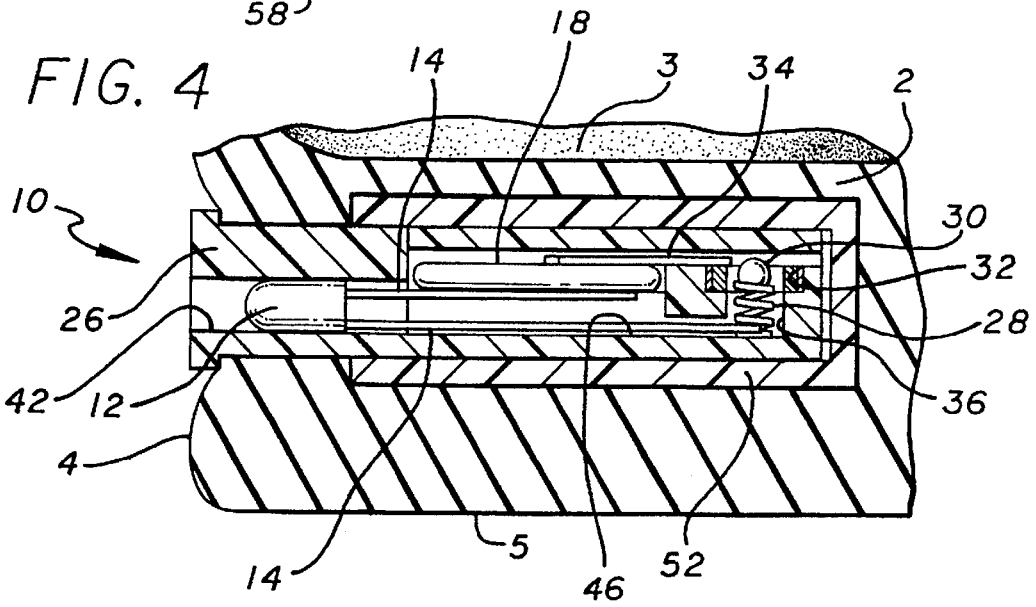
FIG. 4 is a partial, side sectional view into the sole, retaining receptacle, and lighting system of the shoe of FIG. 1, as revealed by the section taken along the lines 4—4 in FIG. 3, and wherein a spring-mass cavity in the lighting system is shown with its long axis normal to a bottom surface of the shoe.

An exemplary preferred embodiment of the inertially responsive footwear lighting system 10 of the present invention is depicted in an isometric view in FIG. 1, shown there withdrawn from the sole portion 2 of the shoe, and in a top plan view in FIG. 3, in cross-section in FIG. 4, schematically in FIG. 6, and in an exploded view in FIG. 9. The lighting system 10 comprises at least one electrical light source 12 having a pair of electrical terminals, or leads 14, a source of electrical power, preferably a dry-cell battery 16 having positive and negative poles 18, 20, electrically conductive circuit means 22 to convey power from the poles of the battery to the leads of the light source, and inertially responsive switching means 24 disposed within the circuit means to switch the light source on and off in a manner described in more detail below.

In the exemplary embodiment illustrated, the light source 12 consists of a light-emitting diode ("LED"), although an incandescent source, including so-called "halogen"-filled lamps, can be substituted for the LED. However, LED's are preferable to incandescent sources in this particular application because, although the latter are typically brighter in appearance for a given applied voltage, the former are far more efficient in converting the electrical power of the battery to visible light, resulting in extended battery life. The only limitation involved in using LED's as the light source is the limited range of their presently available colors, viz., red, green, blue and yellow-orange. Another consideration with LED's is that they are polarity-sensitive, i.e., light-producing current will flow through them in only one direction. Therefore, care must be taken to observe that the poles of the battery 16 are connected to respective leads of the LED with the correct polarization of its anode and cathode in order to obtain current flow, i.e., the diode must be "forward-biased," and not "reverse-biased," to function as a source of light. LED's are available from a wide variety of electronic supply houses in a wide variety of voltages, brightnesses, and "lens" configurations, i.e., differently shaped plastic diode cases, to provide different ray patterns, or beam shapes, for the emitted light. The preferred power source 16 consists of a 3-volt, dry-cell, lithium-based, coin-shaped "button cell" of the type commonly sold across the counter for use in watches, calculators, electronic games, and the like. These batteries are typically about the size of a quarter, and can supply up to several hundred milliampere-hours of useful life, particularly if not drained continuously for prolonged periods.

As may be seen from the schematic diagram of the preferred embodiment of the lighting system 10 shown in FIG. 6, the electronics of the system are very simple and straightforward. The light source 12 is connected in series with the battery 16 through the switching means 24 by the circuit means 22. Indeed, in the preferred embodiment, the stock leads 14 provided on a LED can comprise a substantial portion of the circuit means if utilized in the manner described below. A first one of the leads, and in the case of an LED, the cathode lead, is connected directly to the negative pole of the battery 16, preferably in the manner described below.

The novel switching means 24 of the lighting system 10 comprise a base, or housing, 26 mounted within the footwear such that it is fixed relative to the footwear. In the exemplary embodiment illustrated, the base comprises a transparent, non-conductive, injection-molded thermoplastic part, so that light emitted from the light source 12 can pass through it without much diffusion or attenuation. If desired, various lensing devices, such as diffractors, prismatic lenses, etc. can be molded directly into the base adjacent to the light source. In an alternative embodiment, the base can be molded in a transparent color to match the color of the light source, and thereby enhance the color effect of its light.

An elongated spring 28 is attached to the base 26 such that at least a portion of the spring is resiliently moveable with respect to the base. In the embodiment illustrated in FIG. 4, the spring is shown as a helically-coiled steel, or other conductive alloy, wire. Other spring cross sections, such as a "rod" shape or a flat strip, can also function satisfactorily. The spring has first and second ends, and is cantilevered upwardly from the base by its first end such that the second end is free to move relative to the base. The first end is connected electrically to the circuit means 22, as by crimping or soldering, and in the embodiments illustrated, is connected directly to the end of the second one of the leads 14 of the light source 12, and in the case of an LED, its anode lead, thereby using the stock leads of the LED to achieve a small but desirable economy of interconnections and hook-up wire.

An electrically conductive mass 30 is attached to the moveable end of the spring 28, and through the spring, is also connected within the circuit means 22 to one of the leads of the light source 12 to be in series with it, as described above. The mass forms a moveable electrical contact and, together with the spring, defines a classic, inertially responsive, spring-mass system 28, 30 having an equilibrium position relative to the base along the long axis of the spring, and at least two degrees of freedom of harmonic, or oscillatory, movement about that equilibrium position, i.e., both longitudinally along, and transversely to, the long axis of the spring. In the exemplary embodiment illustrated in the figures, the mass 30 comprises a steel sphere, such as a ball bearing, soldered or welded to the free end of the spring, but other shapes and conductive materials will also function in this capacity as well, such as a bolus of lead or Babbitt soldered onto the end of the spring, or even a small metal screw threaded into the open end of the coil spring.

An electrically conductive contact, or surface, 32 is attached to the base 26 in opposed relation to the mass 30, and, in the embodiments illustrated, is connected in series to the positive pole of the battery 16 within the circuit means 22 by means of a battery spring-contact 34 such that, when the mass is in contact with the surface, the circuit between the battery and the light source 12 is complete, thereby switching the light source on, and when the mass is separated from the surface, the circuit is interrupted, thereby switching the light source off.

In the exemplary preferred embodiments illustrated, the conductive surface 32 is disposed on the interior surface of a spring-mass cavity 36, which is molded into the base 26. The spring-mass cavity 36 is preferably cylindrical in shape, and the spring-mass system is preferably disposed coaxially within it such that the equilibrium position of the spring-mass system coincides with the long axis of the cavity.

The battery spring-contact 34, which is conductively attached to the conductive surface 32, is made of a conductive, highly resilient metal, such as a beryllium-copper alloy, or a heat-treated steel, and performs several functions. It connects the conductive surface 32 to the positive pole of the battery 16, and, if the base 26 is molded to contain a battery compartment 38 having a floor 40 in it, the battery spring-contact 34 can also serve to retain the battery within the battery compartment against the cavity floor. Further, if the base is also formed to include a bore 42 for mounting the light source 12, and if the bore is extended into the battery compartment by means of a groove 44 (see, FIG. 3) having an appropriate depth into the floor of the compartment, a lead of the light source can be disposed within the groove such that a lateral portion of the lead will extend slightly above the compartment floor to form a contact for the battery. Then, when the bottom surface of the battery, which comprises its negative pole, is forced down onto the lead by means of the battery contact-spring, an electrical connection is made in the circuit means 22 between the light source and the battery, thereby resulting in a second economy of hookup wire and interconnections within the circuit, while still permitting the battery to be easily removed from the circuit without the need to unsolder it.

In the exemplary embodiments illustrated in FIGS. 3 and 4, the conductive surface 32 can be formed as a split sleeve, or ferrule, which, if properly sized, can be pressed down with a slight force fit into the spring-mass cavity 36 such that it is rotatable therein about the long axis of the cavity. If the battery contact-spring 34 is formed onto the sleeve, this rotational feature can be used as a means for journelling the contact-spring such that it can be rotated over, or away from, the top of the battery when it becomes desirable to replace the battery in the circuit.

If a second lead groove, or bore, 46 is molded into the base 26 such that it extends from the light source mounting bore 42 to and through the bottom wall of the spring-mass cavity 36, then the other lead of the light source can be introduced through the groove to the first end of the spring 28 for connection directly to it, as described above.

Skilled practitioners will recognize that the spring 28, even a coiled one, will ordinarily be stiffer along its long axis than in a direction normal, or transverse, to that axis, i.e., it will have a higher spring rate along its long axis than it does in the direction normal thereto. This means that, usually, the spring-mass system will be more "sensitive," i.e., will be more easily set into harmonic motion, by a given inertial force acting on the mass 30 in the direction normal to its long axis, than it will be by the same force acting along the long axis of the spring. Accordingly, although it is possible to envision inertially responsive switching means 24 for the present invention in which motion along the long axis of the spring-mass system is of interest, for purposes of the exemplary embodiments illustrated herein, it is motion of the spring-mass system in the direction normal, or transverse, to the long axes of the spring 32 and the cavity 36 that is of particular interest.

In normal running and jumping activities, the heel usually strikes the ground first and at a slight angle with respect to the ground, such that the reactive force vector acting on the footwear by the ground can usually be resolved into two components, one acting along the bottom surface 5 of the sole portion 2, and one acting normal to that surface. Conversely, in kicking activities, the toe of the footwear usually contacts the object kicked, and in a "head-on" fashion, such that both the accelerative force on the footwear to initiate the kick, and the reactive force on it from the object kicked, is directed primarily in a direction parallel to the bottom surface of the footwear.

Figure 5:
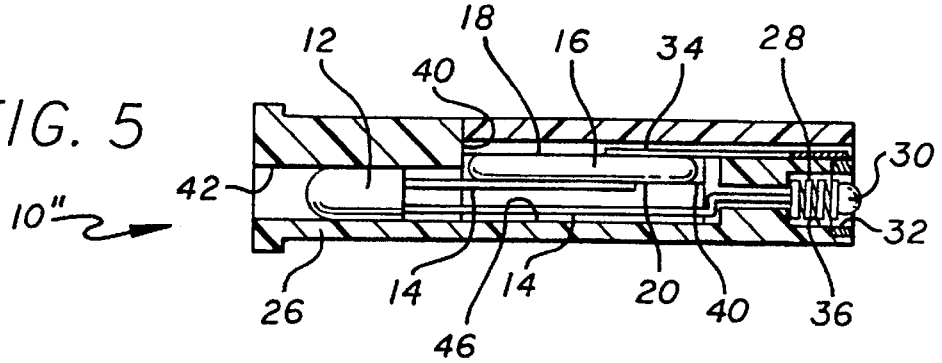
FIG. 5 is a partial, side sectional view into an alternative embodiment of a lighting system similar to that shown in FIG. 4, except that the spring-mass cavity of the lighting system is shown with its long axis parallel to the bottom surface of the shoe.

Thus, the orientation of the spring-mass system 28, 30 with respect to the bottom surface of the footwear can result in different dynamic responses and sensitivities of the switching means 24 to different types of wearer activities. In the exemplary embodiment of lighting system 10 illustrated in FIGS. 3 and 4, the cavity is oriented with its long axis disposed generally normal to the bottom, ground-contacting surface 5 of the footwear, and will be relatively more sensitive to both stepping and kicking activities, whereas, in the alternative embodiment of lighting system 10" seen in FIG. 5, the cavity is oriented with its long axis disposed generally parallel to the footwear's ground-contacting surface and will be more predominantly sensitive to stepping activities. Thus, the orientation of the spring-mass system can be pre-disposed in such a manner to be more responsive to certain types of activities than to others. Also, the requisite amplitude of force necessary to initiate flashing of the light source can be predetermined, to a large degree, by controlling the spacing between the mass 30 and the conductive surface 32, as well as the stiffness of the spring 28, for reasons explained in more detail below.

Those skilled in the art will recognize that there is at least one frequency and amplitude of a sinusoidally varying force that, if applied to the spring-mass system 28, 30 in a direction normal to the long axis of the spring, will result in an oscillatory movement of the mass 30 about its equilibrium position within the spring-mass cavity 36 such that, in one cycle, the mass will momentarily contact the conductive surface 32 twice, once on each side of the cavity, thereby resulting in two brief flashes of light per cycle, which flashes repeat, continuously, until the oscillatory driving force is removed. That is, the switching means 24 can act as a simple, electro-mechanical oscillator. While this response mode of the switching means is of some interest because of the dynamic lighting effect it produces, the mode of excitation necessary to produce it is not one that is likely to occur very often in normal footwear use. Rather, it is the response of the switching means 24 to an impulse force, or force pulse of short duration, such as would be imposed on the footwear when striking the ground, or kicking an object, that is of more interest here.

FIGS. 7 and 8 represent graphically the harmonic response of the exemplary spring-mass system 28, 30 to an impulse force applied to the system in a direction normal to the long axis of the system, where time is plotted along the abscissa, and displacement of the mass 30 from its equilibrium position is plotted along the ordinate. As may be seen in FIG. 7, for a system in which the spring 28 is assumed to be relatively short, stiff, and mass-less, and wherein the displacement of the mass 30 is "unconstrained," such as by the conductive surface 32 and cavity 36, the response of the spring-mass system to an impulse force will be an oscillatory motion that decays rapidly and exponentially, as represented by the dotted lines, with time. However, if the displacement of the mass is constrained, as by the conductive surface and the walls of the spring-mass cavity, as represented by the phantomed lines in FIG. 8., then the harmonic motion of the mass will be "clipped" by its contact with the conductive surface such that the two will briefly contact one another, then separate, for a few cycles of the mass, thereby causing the light source to flash on and off a few times, until the oscillatory displacement of the mass decays to be less than the spacing between the equilibrium position of the mass and the conductive surface.

Those skilled in the art will recognize that the response of the spring-mass system as represented by the graph in FIG. 8 is, in reality, more complex than the first order approximation shown therein. This is because the impact of the mass 30 on the conductive surface 32 results in a fairly elastic collision of the two objects, with a resultant "rebound" effect on the mass in which it is impelled away from the conductive surface at speeds up to its approach velocity. However, the portion of the spring 28 that moves relative to the base 26 must continue briefly to swing toward the walls of the cavity because, in reality, the spring is not actually massless, as assumed. This sets up a complex, higher-order harmonic motion in the spring in which vibration "nodes" are set up along the length of the spring, akin to those occurring in a vibrating string. However, if the spring is kept short and relatively stiff, these higher-order effects can be ignored, and the response shown in FIG. 8 will be a fairly accurate, first-order approximation of the system's actual dynamic response.

While this type of response is not as visually impressive as one in which, say, the lights flash on and off continuously, it does provide a display that is more dynamically interactive with some activity of the wearer, such a walking, running, jumping and kicking, while simultaneously providing a much greater conservation of battery life. Thus, when the wearer's feet are still, the light source is off, conserving battery life, and when the wearer's feet are moving, the light source flashes on an off for a brief interval each time the wearer takes a step, kicks or jumps.

Those skilled in the art may recognize that certain modifications can be made in the implementation of the lighting system 10 of this invention to achieve certain desirable alternative ends. For example, it is fairly easy to mount the spring-mass system 28, 30 off-axis in the cavity 36, such that the mass 30 is continuously biased against the conductive surface 32. This results in a light system 10 in which the light source 12 is continuously on, except when the wearer's foot strikes the ground, whereupon it flashes off and on for a brief interval before returning to the continuously on state. However, it will also be recognized that, while this alternative embodiment can provide a fairly dynamic light display, it will also run down the battery 16 more quickly, especially if the wearer is standing still for extended periods.

More preferably, the base 26 can be configured as a housing having mounting provisions for each of the light source 12, the battery 16, the circuit means 22, and the improved switch means 24, such that all are integrally contained within the housing for easy insertion into or removal from the footwear as a single assembly. To this end, the housing 26 can be provided with a snap-on cover 48 over the spring-mass cavity 36 and the battery compartment 38 to keep out dirt or other contaminants and to provide easy access for battery replacement.

In one alternative preferred embodiment of such an integral assembly, such as that illustrated in FIGS. 1, 3, 4 and 9, the light system 10 can be made plug-in insertable into and removable from a cavity 49 formed in the sole portion 2 of the footwear through an opening 50 in the sidewall 4 of the sole portion, so that light from the light source 12 is visible through or at the opening when the assembly is plugged in, and such that the assembly can be inserted and removed while the footwear is being worn. To this purpose, it may be desirable to provide a rigid receptacle 52 within the cavity in the sole portion to receive and protect the assembly therein. This receptacle can be provided with a locking feature, such as the aperture 54, which is complementary to an over-center locking cam 56 molded onto a lateral side of the housing and carried on a resilient arm that can be depressed toward the center of the housing by a tab 58 on the arm. Thus, to insert the assembly, the wearer inserts the end of the housing opposite to the light source end into the opening 50, then pushes the housing into the receptacle until the cam snaps into the aperture, thereby locking the assembly into the footwear. To remove the assembly, the wearer depresses the tab until the locking cam clears the aperture, and then simply pulls the assembly out of the footwear.

Another alternative preferred embodiment of a plug-in assembly of the lighting system 10' is illustrated in FIG. 2, wherein features similar to those of the embodiment illustrated in FIG. 1 are numbered with similar, but primed, numbers. Here, the lighting system includes a plurality of light sources 12' disposed in spaced relation about a lateral sidewall of the housing 26. The sole portion has a cavity 60' formed into it to receive the lighting assembly in a vertically downward, plug-in fashion through an opening in the upper surface 3' of the sole portion 2'. A plurality of openings 62' extend through the sidewall 4' of the sole portion 2' and into the mounting cavity 60', and are located adjacent the the light sources 12' such that light emitted from each of the light sources is visible through them exteriorly of the footwear. Preferably, the sidewall openings 62' are provided with clear or translucent windows 64' to keep dirt, water or other contaminants out of the lighting system and its mounting cavity.

Indeed, by now, skilled practitioners will recognize that many other modifications are possible in terms of the materials, manufacture, assembly, and mode of operation of the inertially responsive lighting system for footwear of the present invention, depending on the particular problem at hand. Accordingly, the scope of the invention should not be limited by that of the exemplary preferred embodiments of it described and illustrated herein, but rather, by the scope of the claims that are appended hereafter.

What is claimed is:

1. In footwear of a type that includes a lighting system having an electric light, a battery for energizing the light, and an electrical circuit for electrically connecting the battery to the light, improved switching means disposed within the electrical circuit for selectively connecting and disconnecting the battery to and from the light in response to inertial forces acting on the footwear, the improved switching means comprising:

a base portion disposed in the footwear;

a spring attached to the base portion, at least a portion of the spring being resiliently moveable with respect to the base portion;

an electrically conductive mass attached to the moveable portion of the spring to define an inertially responsive, spring-mass member having at least one degree of freedom of movement relative to the base portion and responsive to an inertial force applied to the footwear; and, a conductive surface electrically connected to the battery and disposed within the footwear in opposed relation to the mass such that, when the mass is in contact with the conductive surface, the battery is electrically connected to the light, thereby causing the light to turn on, and when the mass is apart from the surface, the battery is disconnected from the light, thereby turning the light off, wherein an inertial force applied to the footwear causes the light to flash on and off.

2. The footwear of claim 1, wherein the spring mass member has an equilibrium position that is spaced apart from the conductive surface, wherein the light is normally off until an inertial force of sufficient magnitude is applied to the footwear to cause the mass to move a sufficient amount to contact the conductive surface.

3. The footwear of claim 1, wherein the spring mass member has an equilibrium position in contact with the conductive surface, wherein the light is normally on until an inertial force of sufficient magnitude is applied to the footwear to cause the mass to move and separate from the conductive surface.

4. The footwear of claim 1, wherein the base portion comprises a support member formed of a non-conductive material, said support member including a cavity having a long axis and an interior surface, wherein the conductive surface is disposed on the interior surface of the cavity, the spring-mass member being mounted within the cavity and responsive to an applied inertial force to move from an equilibrium position within the cavity in a direction generally perpendicular to the long axis of the cavity.

5. The footwear of claim 4, wherein the long axis of the cavity is disposed generally perpendicular to a bottom, ground-contacting surface of the footwear.

6. The footwear of claim 4, wherein the long axis of the cavity is disposed generally parallel to a bottom, ground-contacting surface of the footwear.

7. The footwear of claim 4, wherein the spring is made of a conductive material and has a long axis and first and second ends, wherein the mass is attached to the first end of the spring such that the spring-mass system is electrically conductive, and wherein the spring-mass system is attached to the base at the second end of spring such that the spring-mass system is disposed in a cantilevered position in the cavity, with the long axis of the spring being parallel to the long axis of the cavity.

8. The footwear of claim 4, wherein the base further comprises a housing, and wherein the light, the battery, the circuit means, and the switch means are integrally contained within the base for insertion into or removal from the footwear as a single assembly.

9. The footwear of claim 8, wherein the housing is insertable and removable through a surface of a sole portion of the footwear in plug-in, releasibly-retained fashion.

10. The footwear of claim 1, wherein the electrical light comprises a light emitting diode.

11. Footwear having a lighting system that flashes on and off in response to inertial forces acting upon the footwear, comprising:

a flexible upper portion adapted to surround at least a portion of an upper surface of a wearer's foot;

a sole portion attached to the upper portion and adapted to underlie the wearer's foot and to contact the ground;

at least one electrical light source disposed in the footwear such that light emitted from the source is visible exteriorly of the footwear;

a battery for powering the light source;

electrical circuit means for electrically connecting the battery to the light source; and switching means for flashing the light source on and off in response to forces incident upon the footwear, said switching means comprising:

a base disposed within the footwear;

an electrically conductive spring-mass system resiliently mounted on the base and electrically connected to the circuit means, the spring-mass system having at least one degree of freedom of harmonic motion relative to an equilibrium position on the base in response to a force acting on the base; and, an electrically conductive surface connected to the circuit means and mounted in opposed relation to, and within a range of motion of, the spring-mass system such that, when the spring-mass system moves into contact with the electrically conductive surface, the battery is electrically connected to the light, thereby switching the light source on, and when the spring-mass system and the electrically conductive surface are separated, the battery is electrically disconnected from the light source, thereby switching the light source off.

12. The footwear of claim 11, wherein the spring-mass system is positioned such that, when the spring-mass system is in the equilibrium position, the light source is switched off.

13. The footwear of claim 11, wherein the spring-mass system is positioned such that, when the spring-mass system is in the equilibrium position, the light source is switched on.

14. The footwear of claim 11, wherein the base contains a cavity having an interior surface, the electrically conductive surface being disposed on the interior surface of the cavity, and wherein the spring-mass system is mounted within the cavity in opposed relation with the conductive surface.

15. The footwear of claim 14, wherein the base further comprises:

a housing made of a rigid, non-conductive material, the housing having a battery compartment, and a bore extending through a sidewall of the housing and into the battery compartment, the battery being housed within the battery compartment, the light source including a pair of electrical leads and being mounted in the bore such that one of the leads extends into the battery compartment and makes electrical contact with the battery, the other of the leads of the light source extending through the housing and being electrically connected to the spring-mass system; and, an electrical contact having first and second ends, the first end of the contact being electrically connected to the conductive surface, and the second end of the contact being in electrical contact with the battery.

16. The footwear of claim 15, wherein the housing further comprises a removable cover positioned over the battery compartment.

17. The footwear of claim 15, wherein the sole portion includes a cavity, the housing being insertable into and removable from the cavity through an opening in a surface of the sole portion in a plug-in, releasibly-retained fashion.

18. The footwear of claim 17, wherein the housing is insertable into and removable from the cavity through at least one sidewall opening in the sole portion of the footwear.

19. The footwear of claim 17, wherein the housing is insertable into and removable from the cavity through an opening in an upper surface of the sole portion.

20. The footwear of claim 17, wherein the cavity in the sole portion is provided with a receptacle to receive the housing in a plug-in, releasibly-retaining engagement.

* * * * *